US007819828B2

(12) United States Patent
Anderson

(10) Patent No.: US 7,819,828 B2
(45) Date of Patent: Oct. 26, 2010

(54) ROLLING SCALP INVIGORATOR

(76) Inventor: Douglas C. Anderson, 52 Stevens St., White Plains, NY (US) 10606

( * ) Notice: Subject to any disclaimer, the term of this patent is extended or adjusted under 35 U.S.C. 154(b) by 0 days.

(21) Appl. No.: 11/037,953

(22) Filed: Jan. 18, 2005

(65) Prior Publication Data

US 2006/0084894 A1 Apr. 20, 2006

Related U.S. Application Data

(60) Provisional application No. 60/619,871, filed on Oct. 19, 2004.

(51) Int. Cl.
*A61H 15/00* (2006.01)

(52) U.S. Cl. ..... 601/118; 601/120

(58) Field of Classification Search ..... 601/118–123
See application file for complete search history.

(56) References Cited

U.S. PATENT DOCUMENTS 444,597 A * 1/1891 Lichtenstadt ..... 601/20
1,185,583 A * 5/1916 Bond ..... 601/118
1,560,549 A * 11/1925 Duncan ..... 601/120
4,142,519 A * 3/1979 Ferguson ..... 601/118
4,744,350 A * 5/1988 Sato ..... 601/119
4,989,585 A * 2/1991 Auker ..... 601/118
5,067,480 A * 11/1991 Woog et al. ..... 601/46
5,554,102 A * 9/1996 Chiou ..... 601/72

FOREIGN PATENT DOCUMENTS

FR 2723302 A1 * 2/1996

* cited by examiner

*Primary Examiner*—Michael A. Brown
(74) *Attorney, Agent, or Firm*—Philip M. Weiss; Weiss & Weiss

(57) ABSTRACT

A method and device for stimulating new capillary growth and increased circulation in areas where the blood flow is no longer sufficient to support hair growth, new hair or existing hair.

10 Claims, 3 Drawing Sheets

ROLLING SCALP INVIGORATOR

RELATED APPLICATIONS

The application claims priority to provisional patent application Ser. No. 60/619,871 filed Oct. 19, 2004.

FIELD OF THE INVENTION

The present invention relates to a method and device for stimulating new capillary growth and increased circulation in areas where the blood flow is no longer sufficient to support hair growth, new hair or existing hair.

BACKGROUND OF THE INVENTION

U.S. Pat. D414,875 relates to a rolling device used to massage the body.

U.S. Pat. D387,873 relates to a massage rod for massaging the body.

U.S. Pat. No. 5,458,561 relates to a massage device for the rolling massage of skin areas and reflex zones of the body. A shaft is mounted on a handle and massage rings or rolling bodies which are freely rotatably mounted on the shaft. The massage rings or rolling bodies have projections which are uniformly distributed in circumferential direction.

U.S. Pat. No. 4,744,350 relates to a scalp massager having resiliently biased roller with optional internal magnet. The scalp massager has a main body provided on the rear end thereof with a grip portion, a base portion, a pair of supporting arms projecting laterally from the base portion and spaced from each other in the longitudinal direction of the base portion, a roller member rotatably mounted between the arms for rotation about an axis substantially parallel to the longitudinal axis of the base portion.

The roller member is provided on the outer peripheral surface thereof with a multiplicity of scalp stimulating projections, and compression springs for resiliently biasing the roller member away from the grip portion. The user grips the grip portion and lightly presses the roller member onto the head, and moves the massager back and forth so that the roller member rolls on the scalp with the result that the projections stimulate blood vessels under the scalp so as to enhance the blood stream. The roller member, which is resiliently urged by the compression springs, can gently and uniformly contact the scalp so as to moderately stimulate the head without any risk for the scalp to be damaged.

SUMMARY OF THE INVENTION

The present invention relates to a device that can be rolled over a person's scalp. The device comprises a handle which can be operated either by one hand, two hands, or a single finger. By pushing and pulling the device a roller rolls across the person's scalp. Protrusions of various sizes and dimensions are placed on the roller, and arranged in various patterns. It is an object of the present invention for the protrusions to have a ball on the end which touches the scalp. These balls can be of various sizes. When the roller rolls over a person's scalp repeatedly, the beneficial rewards from the device are achieved.

The present invention relates to a device for increasing the circulation and distribution of hair oils. It is an object of the present invention to increase the growth of new capillaries. It is an object of the present invention for the device to have one single handle. It is and object of the present invention for the device to have multiple handles. It is an object of the present invention for the device to operate by using a single finger. It is an object of the present invention for a motor to be placed inside the device to allow the device continuously roll over a person's scalp.

It is an object of the present invention to promote blood flow to the scalp from several different areas. It is an object of the present invention to stimulate new capillary growth in areas where blood flow is no longer sufficient to support hair growth, new hair or existing hair. It is an object of the present invention to cause increased production and/or circulation of hair oils. It is an object of the present invention to cause increased production and/or distribution of pigment-making melanocytes. It is an object of the present invention for the device to provide reciprocating action over the scalp thereby compressing the scalp and the individual hair follicles.

The present invention relates to a device that can be placed in a person's hat or head covering and stimulates a person's scalp. It is an object of the present invention for the device to be attached to a hat or cap, and when it is placed on a person's head, the user can turn on the device, which has a motor, causing the device to rotate and stimulate the scalp. The device can be attached to different portions of a cap or hat so that it can effect different portions of a person's scalp. Protrusions of various sizes and dimensions are placed on the roller. When the roller rolls over a person's scalp repeatedly, the beneficial rewards from the device are achieved.

It is an object of the present invention for the device to be able to be hooked up to a shower head. The use of the hot water from the shower head can make the roller hot when it touches against the scalp.

It is an object of the present invention to cause the muscle and tissue structure in the scalp to change causing the existing hairs to bristle and thereby further enhancing the flow of blood to the scalp and hair follicles.

DETAILED DESCRIPTION OF THE INVENTION

Figure 1:
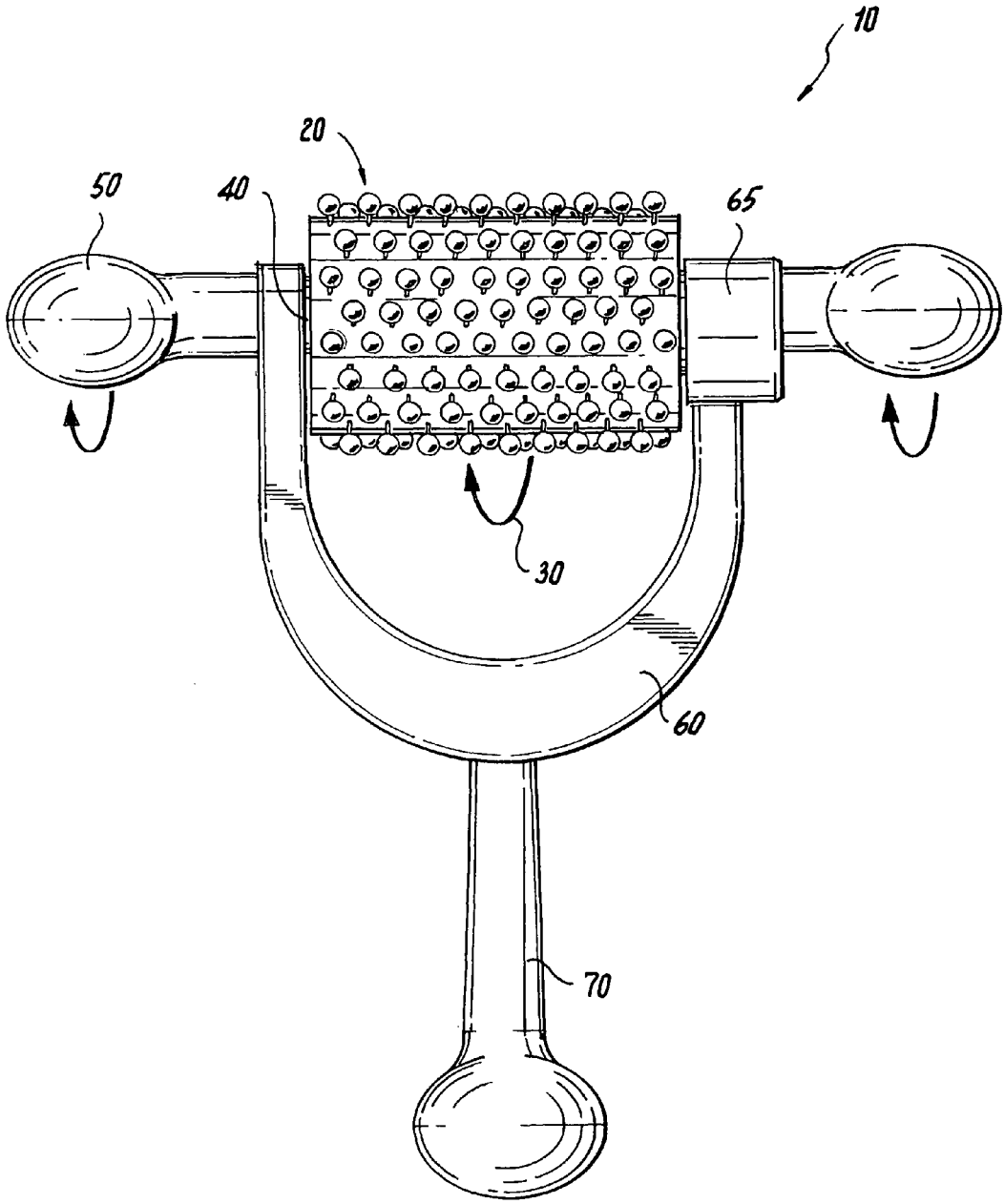
FIG. 1 is a side view of the device of the present invention.

FIG. 1 shows device 10 having a rolling scalp invigorator activator 20. The activator 20 rolls over a person scalp as shown by arrow 30. The device has a central spindle 40 and a spinning handle 50. The device can further comprise a single handle 70 having a single hand operator 60. The device can have a motor 65 which allows the activator 20 to roll without any manual force.

Figure 2:
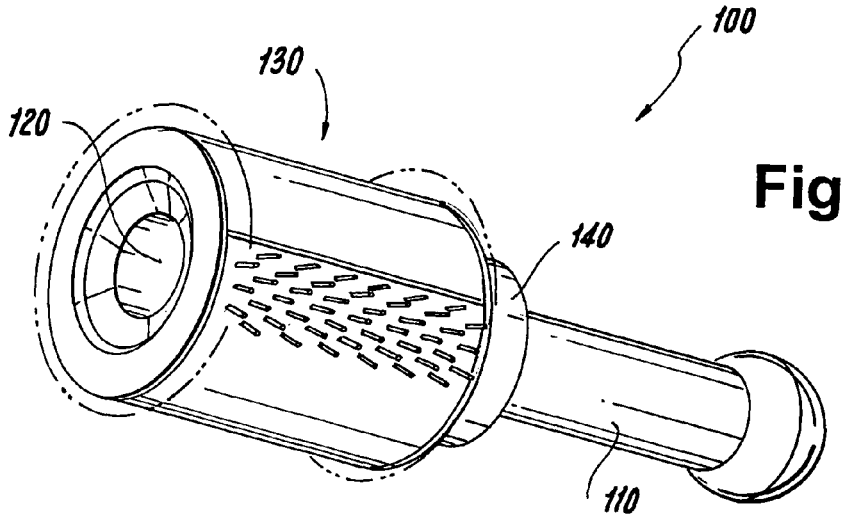
FIG. 2 is a side view of the device of the present invention.

FIG. 2 shows a device 100 having a handle 110 and an opening for placing a finger 120. The device has spines 130 which are placed against a person's head in reciprocating fashion. The device may have a motor 140 which rotates the spines 130 without any manual force.

Figure 3:
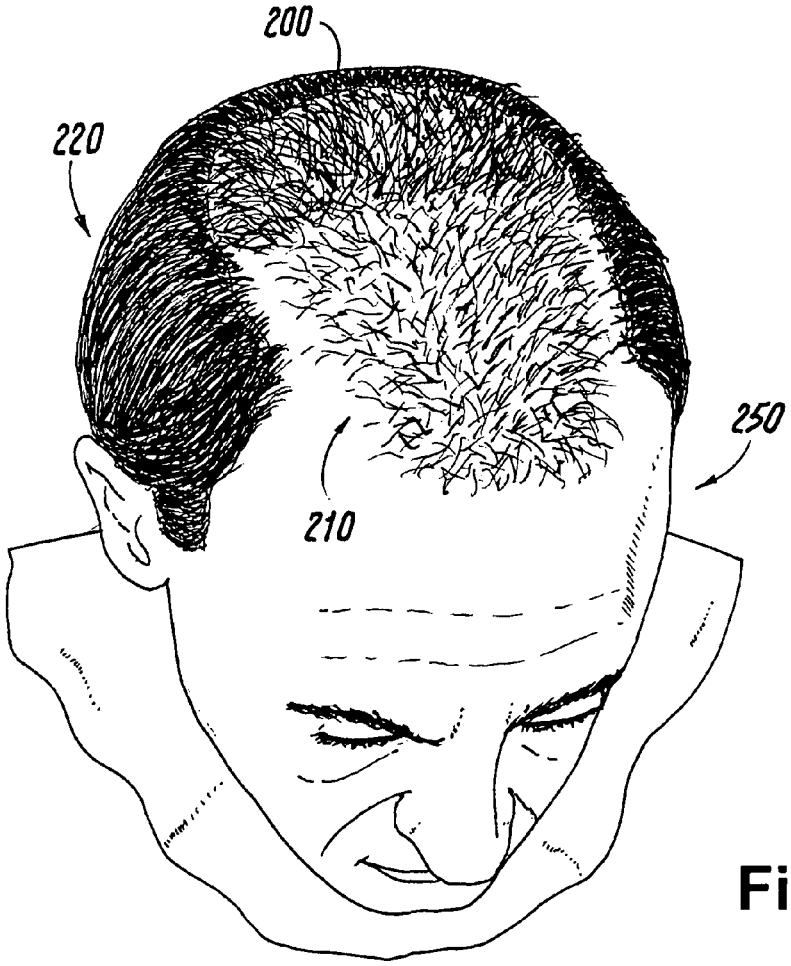
FIG. 3 is a top view of a subject's head showing a person's head after 5½ months of treatment with the device of the present invention.

FIG. 3 shows a subject 250. The head has hair having areas that have been filled in completely 200 and areas that are beginning to fill in 210. As shown, the outer side of the head has achieved maximum density 220. Inside that area, are areas that have been filled in completely and areas that are beginning to fill in. Hair growth appears to be in the reverse pattern of male pattern baldness.

Figure 4:
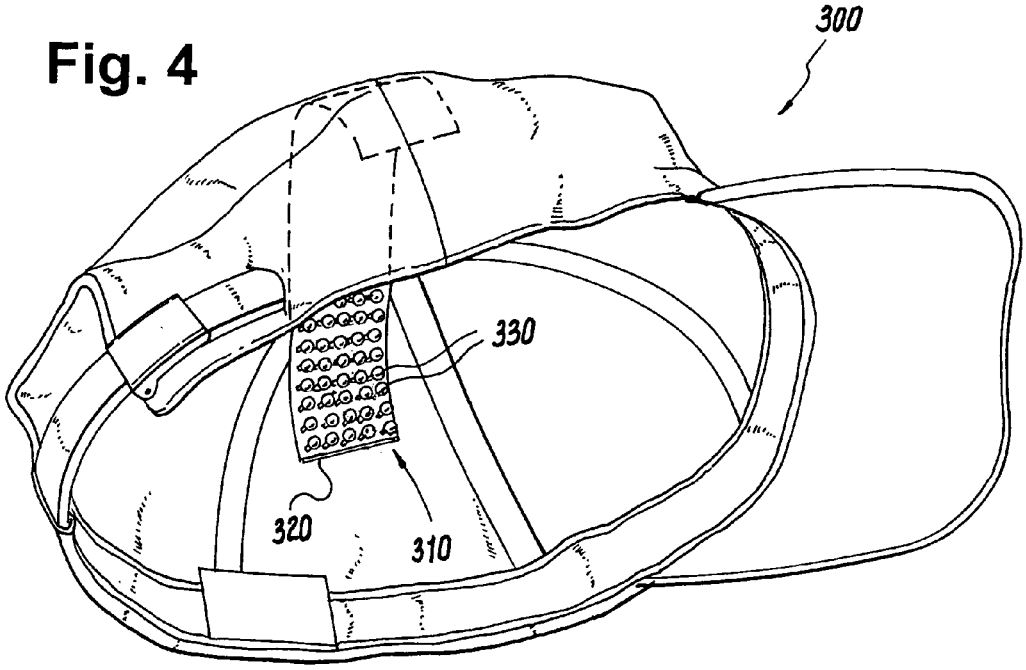
FIG. 4 shows the device of the present invention attached to a head covering.

FIG. 4 shows a head covering 300 having a device 310 attached to the covering by a removable attachment 320. The attachment can comprise a Velcro or removable adhesive for example. The device has projections 330 that rub against a person's scalp when the covering 300 is placed against the scalp.

In one example, the device was used on the side of a person's head where capillaries were still in place and the hair was only thin, as opposed to entirely absent. The result was the hair came back to maximum density within six weeks.

Figure 5:
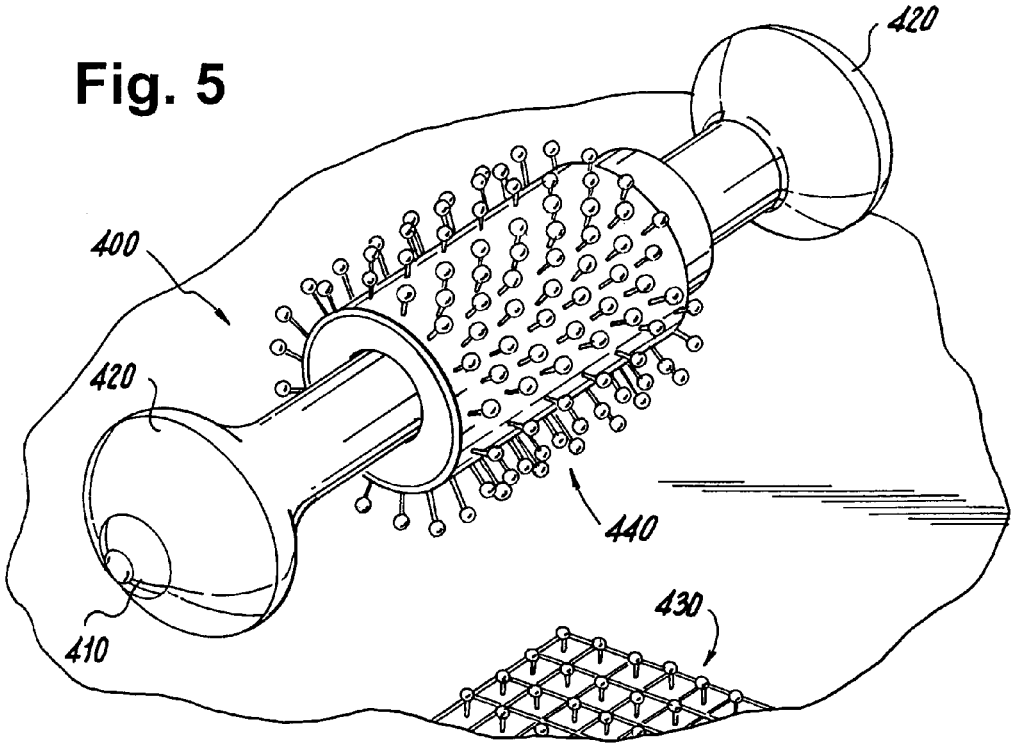
FIG. 5 illustrates a top view of the device of the present invention.

FIG. 5 illustrates a top view of the device 400. The device 400 comprises a central spindle 410, spinning handles 420, invigorators 430 which are placed on the device as shown in 440. The device spins in a direction a shown by arrow 450. The device can have a motor which spins the invigorators.

The invention claimed is:

1. A device for increasing capillary growth to a person's scalp comprising:

a rolling scalp invigorator activator;

a central spindle;

said central spindle comprising single linear or straight protrusions extending along a substantial portion of said spindle; and a handle;

said handle comprises at least one spinning handle which spins separately from said central spindle.

2. The device of claim 1 wherein said handle comprises two handles to be used by two hands.

3. The device of claim 1 wherein said handle is a single handle.

4. The device of claim 1 wherein said handle has an opening for inserting a single finger.

5. The device of claim 1 further comprising a motor.

6. The device of claim 1 further comprising a showerhead and an attachment for attaching said device to said showerhead.

7. The device of claim 6 wherein hot water from said shower head makes said device hot when it touches a person's scalp.

8. The device of claim 1 wherein said central spindle comprises protrusions of various sizes and dimensions.

9. The device of claim 1 wherein said protrusions have a ball on its end which touches scalp.

10. A method for increasing capillary growth to a person's scalp comprising:

placing a device having a handle, a central spindle comprising single linear or straight protrusions extending along a substantial portion of said spindle and a scalp invigorator activator on a person's scalp;

compressing said scalp and individual hair follicles; and rolling in a reciprocating action across a person's scalp said device;

causing said handle to spin separately from said central spindle.

* * * * *